US009082377B2

(12) United States Patent
Sato

(10) Patent No.: US 9,082,377 B2
(45) Date of Patent: Jul. 14, 2015

(54) BASS DRUM LIFTER AND BASS DRUM

(71) Applicant: HOSHINO GAKKI CO., LTD., Nagoya, Aichi (JP)

(72) Inventor: Naoki Sato, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 223 days.

(21) Appl. No.: 13/776,708

(22) Filed: Feb. 26, 2013

(65) Prior Publication Data

US 2014/0090541 A1 Apr. 3, 2014

(30) Foreign Application Priority Data

Sep. 28, 2012 (JP) ..... 2012-215833

(51) Int. Cl.
*G10D 13/02* (2006.01)

(52) U.S. Cl.
CPC ..... *G10D 13/026* (2013.01)

(58) Field of Classification Search
USPC ..... 84/421, 422.1
See application file for complete search history.

(56) References Cited

U.S. PATENT DOCUMENTS 2,563,346 A * 8/1951 Livingston ..... 84/412
2006/0005689 A1* 1/2006 Ito ..... 84/422.1
2012/0174732 A1 7/2012 Martinazzi

FOREIGN PATENT DOCUMENTS

JP 2006-047976 A 2/2006

OTHER PUBLICATIONS

Japanese Office Action dated Oct. 1, 2014 issued in Japanese Patent Application No. 2012-215833.

* cited by examiner

*Primary Examiner* — Jianchun Qin

(57) ABSTRACT

A bass drum lifter is provided with a drum connection member, a pedal connection member including a lift portion, and a long screw for rotationally connecting the pedal connection member and the drum connection member to each other. The pedal connection member is rotational around the axis of the long screw between a storage position in the vicinity of a shell of a bass drum and a use position at which the bass drum is lifted up by the lift portion. The long screw is arranged in the vicinity of the shell and in the vicinity of the batter head.

6 Claims, 5 Drawing Sheets

BASS DRUM LIFTER AND BASS DRUM

BACKGROUND OF THE INVENTION

The present invention relates to a bass drum lifter for use in lifting a part of a bass drum in the vicinity of the batter head, and a bass drum having the bass drum lifter.

In general, a bass drum with a small diameter is played with a part in the vicinity of the batter head lifted up so that the center of the batter head is hit by the beater. In this case, a bass drum lifter is used as a device to lift the part in the vicinity of the batter head.

For example, a bass drum lifter 100 disclosed in Japanese Laid-Open Patent Publication No. 2006-047976 includes, as shown in FIG. 8, a retainer 101 connected to a shell S of a bass drum, a base 102 connected to a pedal device P, and a shaft 103 for rotationally connecting the retainer 101 and the base 102 to each other. The bass drum lifter 100 according to this document is used by placing the base 102 on a floor surface F and connecting the distal end of the base 102 to the pedal device P. When the bass drum lifter 100 is not used, the pedal device P is removed from the bass drum lifter 100 and then the base 102 is placed in a storage position in the vicinity of the shell S by being rotated around the axis of the shaft 103 as shown by alternate long and two short dashed lines in FIG. 8.

In addition, a bass drum lifter 110 disclosed in U.S. Pat. No. 2,563,346 includes, as shown in FIG. 9, a hinge 111 connected to a shell S, a leg 112 fixed to a metal piece of the hinge 111, and a base 113 arranged at the lower end of the leg 112. The bass drum lifter 110 according to this document can take a use form as shown by alternate long and two short dashed lines in FIG. 9 and a non-use form as shown by solid lines in FIG. 9 by rotating the leg 112 around the axis of a hinge shaft 111*a*.

The bass drum lifters 100 and 110 according to Japanese Laid-Open Patent Publication No. 2006-047976 and U.S. Pat. No. 2,563,346 can be folded compactly by placing the base 102 and the leg 112 in the storage position. The bass drum lifters 100 and 110 can be stored and carried while being attached to the bass drum in a folded state.

However, the bass drum lifters 100 and 110 have following problems. In the case of the bass drum lifter 100, the retainer 101 includes a loading portion 101*a* adapted to be fixed to an outer peripheral surface of the shell S, and a pair of connectors 101*b* projecting downward from the sides of the loading portion 101*a*. The shaft 103 is fitted to the vicinity of the lower ends of the connectors 101*b*. Therefore, even if the base 102 is placed in the storage position as shown by the alternate long and two short dashed lines in FIG. 8, the base 102 simply rotates around the vicinity of the lower end of the retainer 101 with no significant reduction in the vertical dimension of the bass drum lifter 100. It is therefore impossible to fold the bass drum lifter 100 compactly.

In the case of the bass drum lifter 110, the hinge shaft 111*a* is arranged in a rear position away from a batter head DH. According to the above configuration, the front-rear dimension of the base 113 when the leg 112 is placed in the use position is set to be relatively long based on a distance d between a position connected to the pedal device P and the hinge shaft 111*a*. Therefore, even if the leg 112 is placed in the storage position as shown by the solid lines in FIG. 9, the vertical dimension of the bass drum lifter 110 is not reduced so much due to the long dimension of the base 113. Accordingly, similar to the bass drum lifter 100 according to Japanese Laid-Open Patent Publication No. 2006-047976, it is impossible to fold the bass drum lifter 110 compactly.

SUMMARY OF THE INVENTION

Accordingly, it is an objective of the present invention to provide a bass drum lifter that can be folded compactly and a bass drum having the bass drum lifter.

To achieve the foregoing objective and in accordance with a first aspect, the present invention provides a base drum lifter adapted to be connected to a part of a bass drum in the vicinity of the batter head and to a pedal device and adapted to lift the part in the vicinity of the batter head. The bass drum lifter includes a drum connection member to be connected to the bass drum, a pedal connection member including a lift portion for lifting the bass drum, and a shaft for rotationally connecting the pedal connection member and the drum connection member to each other. The pedal connection member is rotational around the shaft between a storage position in the vicinity of the shell of the bass drum and a use position, at which the bass drum is lifted by the lift portion. The shaft is arranged in the vicinity of the shell and in the vicinity of the batter head.

In accordance with a second aspect, the present invention provides a bass drum lifter adapted to be connected to a part of a bass drum in the vicinity of the batter head and to a pedal device, and to lift the part in the vicinity of a batter head. The bass drum lifter includes a drum connection member to be connected to the bass drum and a pedal connection member including a lift portion for lifting the bass drum. The pedal connection member movably supports the drum connection member and is attachable to and detachable from the drum connection member.

In accordance with a third aspect, the present invention provides a bass drum comprising a bass drum lifter. The bass drum lifter is adapted to lift a part of the bass drum in the vicinity of the batter head, and to be connected to the part in the vicinity of the batter head of the bass drum and to a pedal device. The bass drum lifter includes a drum connection member to be connected to the bass drum, a pedal connection member including a lift portion for lifting the bass drum, and a shaft for rotationally connecting the lift portion of the pedal connection member and the drum connection member to each other. The pedal connection member is rotational around the shaft between a storage position in the vicinity of the shell of the bass drum and a use position, at which the bass drum is lifted up by the lift portion. The shaft is arranged in the vicinity of the shell and in the vicinity of the batter head.

DETAILED DESCRIPTION OF THE PREFERRED EMBODIMENTS

A bass drum lifter according to one embodiment of the present invention will now be described with reference to FIGS. 1 to 5. In the following description of the bass drum lifter, a longitudinal direction and a lateral direction are defined as shown in FIG. 2.

Figure 1:
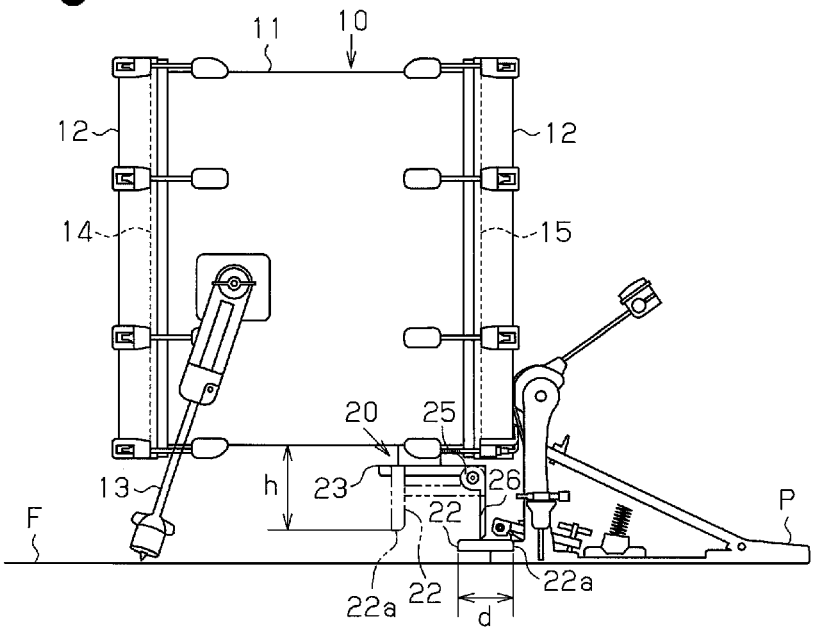
FIG. 1 is a side view showing a state in which a bass drum is lifted up by using a bass drum lifter according to one embodiment of the present invention.

As shown in FIG. 1, a bass drum 10 includes a cylindrical shell 11, a pair of drum heads for closing the opening ends of the shell 11, a pair of hoops 12 fitted with the drum heads to the opening ends of the shell 11, a pair of spiked legs 13 attached to an outer peripheral surface of the shell 11, and a bass drum lifter 20. The spiked legs 13 are arranged in the vicinity of a front head 14, which is one of the drum heads. The bass drum lifter 20 is arranged in the vicinity of a batter head 15, which is the other one of the pair of the drum heads. The bass drum 10 has a smaller diameter than a common bass drum. The bass drum 10 is placed on a floor surface F in a state in which a part in the vicinity of the front head 14 is lifted up by the spiked legs 13 and a part in the vicinity of the batter head 15 is lifted up by the bass drum lifter 20. The bass drum lifter 20 is used by being connected to the bass drum 10 and a pedal device P.

The bass drum lifter 20 has a pedal connection member 22, a drum connection member 23, and a long screw 25 serving as a shaft. The pedal connection member 22 is held by a clamp of the pedal device P and connected to a front part of the pedal device P. The drum connection member 23 is connected to an outer peripheral surface of the shell 11 from below. The long screw 25 functions as a shaft to rotationally connect the pedal connection member 22 and the drum connection member 23 to each other.

Figure 2:
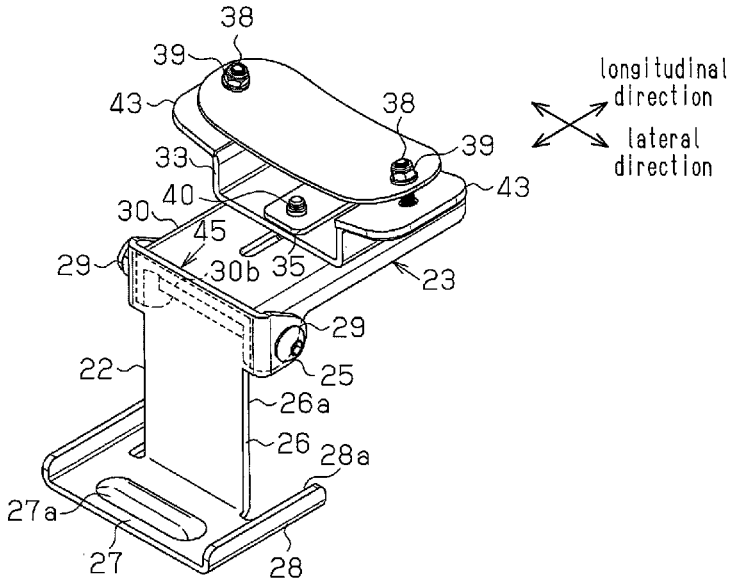
FIG. 2 is a perspective view of the bass drum lifter.
Figure 3:
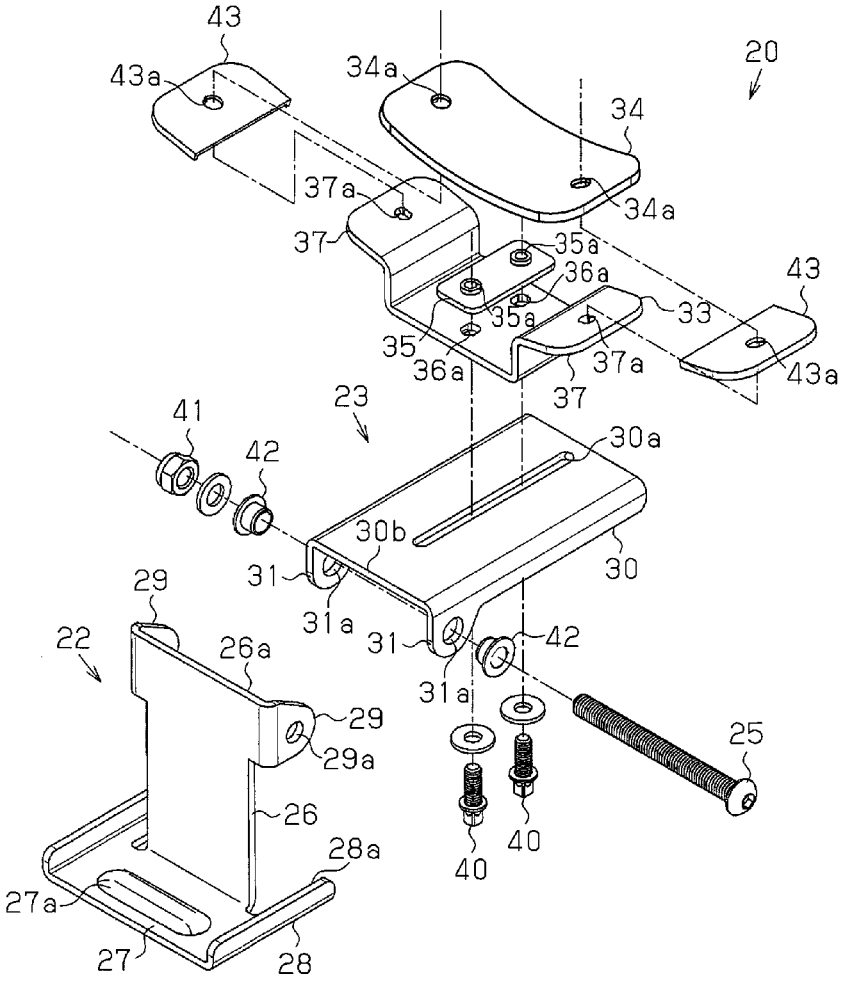
FIG. 3 is an exploded perspective view of the bass drum lifer.

As shown in FIGS. 2 and 3, the pedal connection member 22 has a lift portion 26 for lifting the bass drum 10, a pedal connection portion 27 connected to the pedal device P, and projections 28 abutted on the floor surface F. The pedal connection member 22 is formed by punching a metal plate into a predetermined shape, followed by bending a central portion at a right angle to the remaining portion.

Connection pieces 29 to be connected to the drum connection member 23 are arranged on both sides of the end of the lift portion 26. The connection pieces 29 are formed by bending the sides of the end of the lift portion 26 at a right angle. A hole 29*a* for inserting the long screw 25 is formed in the center of each connection piece 29. The pedal connection portion 27 has a protrusion 27*a* extending in the lateral direction. The protrusion 27*a* reinforces the pedal connection portion 27 formed into a flat plate when it is held by the clamp of the pedal device P. The pedal connection portion 27 including the protrusion 27*a* is set to be of the same thickness as the hoop 12, which is held by the clamp when a part in the vicinity of the batter head 15 is not lifted up.

The projections 28 are formed by portions projecting from both side edges of the pedal connection portion 27. The projections 28 project to the opposite side of the pedal connection portions 27 in relation to the lift portion 26. A rectangular cutout 28*a* is formed between the projections 28. The width of the cutout 28*a* is slightly wider than the width of the lift portion 26. The cutout 28*a* is a recessed formed by bending the central portion of the metal plate at a right angle.

The drum connection member 23 is configured by assembling a plurality of components. That is, the drum connection member 23 is composed of a retainer 30 connected to the lift portion 26, a base 33 placed on the retainer 30, a back plate 34, and a nut plate 35. The retainer 30 extends in the longitudinal direction and has a substantially U-shaped cross section. Connection pieces 31 to be connected to the pedal connection member 22 are arranged on both sides of the end of the retainer 30. A hole 31*a* for inserting the long screw 25 is formed in the center of each connection piece 31. An elongated hole 30*a* extending in the longitudinal direction is formed in the center of the retainer 30.

The base 33 is supported on the retainer 30 to be movable along the elongated hole 30*a*. The base 33 extends in the lateral direction and has a substantially U-shaped cross section. The base 33 has a center part placed on the top surface of the retainer 30 and a pair of fixed portions 37 to be fixed to the shell 11. The center part has a pair of insertion holes 36*a* in positions corresponding to the elongated hole 30*a* of the retainer 30. A shock-absorbing cover 43 made of rubber is attached to each of the fixed portions 37 to cover the surface of the fixed portions 37 facing the shell 11. Insertion holes 37*a* and 43*a* are formed in the center of the fixed portions 37 and the shock-absorbing covers 43, respectively.

Figure 5:
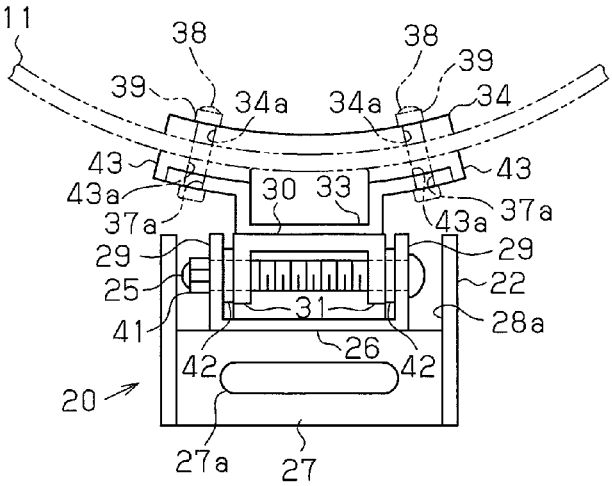
FIG. 5 is a partial front view showing a state in which a drum connection device is partially placed within a cutout of the pedal connection member.

As shown in FIGS. 3 and 5, the back plate 34 extends in the lateral direction and is curved along the inner peripheral surface of the shell 11. The back plate 34 has a pair of insertion holes 34*a* in positions corresponding to the insertion holes 37*a* of the fixed portions 37. The back plate 34 is placed in the inner peripheral surface of the shell 11 to hold the shell 11 with the shock-absorbing covers 43. In order to fix the bass drum lifter 20 to the shell 11, a pair of fixing screws 38 is inserted from the outside of the shell 11 into the insertion holes 37*a*, 43*a* and 34*a* of the base 33, the shock-absorbing covers 43 and the back plate 34, respectively. Nuts 39 are fastened at the distal ends of both of the fixing screws 38 in order to fix the bass drum lifter 20 to the shell 11.

The nut plate 35 is formed into a rectangular shape extending in the longitudinal direction. The nut plate 35 has a pair of screw holes 35*a* in positions corresponding to the insertion holes 36*a* of the base 33. A pair of bolts 40 is screwed to the screw holes 35*a* from the back face of the retainer 30. That is, the bolts 40 are screwed to the screw holes 35*a* by passing through the elongated hole 30*a* and the insertion holes of the base 33. The base 33 is allowed to slide along the elongated hole 30*a* of the retainer 30 by loosening the bolts 40 screwed to the screw holes 35*a*. In this case, the position of the pedal device P relative to the bass drum 10 is changed by sliding the retainer 30 to the base 33 fixed to the bass drum 10. In contrast, the base 33 is fixed to the elongated hole 30*a* of the retainer 30 by fastening the bolts 40 screwed to the screw holes 35*a*, whereby the position of the pedal device P is fixed to the bass drum 10.

The long screw 25 is arranged to pass through the holes 31*a* and 29*a* of the connection pieces 31 and 29 in a state in which the connection pieces 31 of the retainer 30 are placed between the connection pieces 29 of the lift portion 26. The distal end of the long screw 25 is screwed to a hexagonal nut 41. Collars 42 with a flange made of rubber are each fitted between a connection piece 29 and a connection piece 31. The long screw 25 is fastened to the hexagonal nut 41 by a predetermined torque. Therefore, the collars 42 are collapsed between the connection pieces 29 and 31 and connection torque of the pedal connection member 22 to the drum connection member 23 is maintained at a predetermined magnitude. Tightening torque of the long screw 25 or connection torque of the pedal connection member 22 is set to a magnitude that prevents the pedal connection member 22 from opening on its own to the drum connection member 23 and allows a user to comfortably operate rotation of the pedal connection member 22.

In a state where the bass drum lifter 20 is connected to the bass drum 10 as shown in FIG. 1, the pedal connection member 22 is rotational between a storage position, which is in the vicinity of the shell 11 of the bass drum 10, and a use position, in which the bass drum 10 is lifted up by the lift portion 26. As shown in FIGS. 2 and 3, a rotation restricting member 45 for restricting rotation of the pedal connection member 22 beyond the use position is provided in a connection portion of the lift portion 26 and the drum connection member 23. The rotation restricting member 45 restricts rotation of the pedal connection member 22 by causing a back face 26*a* of the lift portion 26 to abut on an end surface 30*b* of the retainer 30. That is, the rotation restricting member 45 restricts further opening of the pedal connection member 22 beyond an open state at a substantially right angle to the drum connection member 23.

Moreover, the retainer 30 is attachable to and detachable from the base 33. Specifically, the retainer 30 is removed from the base 33 along with the pedal connection member 22 by pulling out both bolts 40 from the nut plate 35. In contrast, the retainer 30 is attached to the base 33 along with the connection member 22 by fastening both bolts 40 to the screw holes 35*a* of the nut plate 35.

As described above, the axis of the long screw 25 coincides with the center of rotation of the pedal connection member 22 in relation to the drum connection member 23. According to the present embodiment, the rotational center of the pedal connection member 22 or the position of the long screw 25 is set as follows so that the bass drum lifter 20 can be folded compactly.

Figure 4:
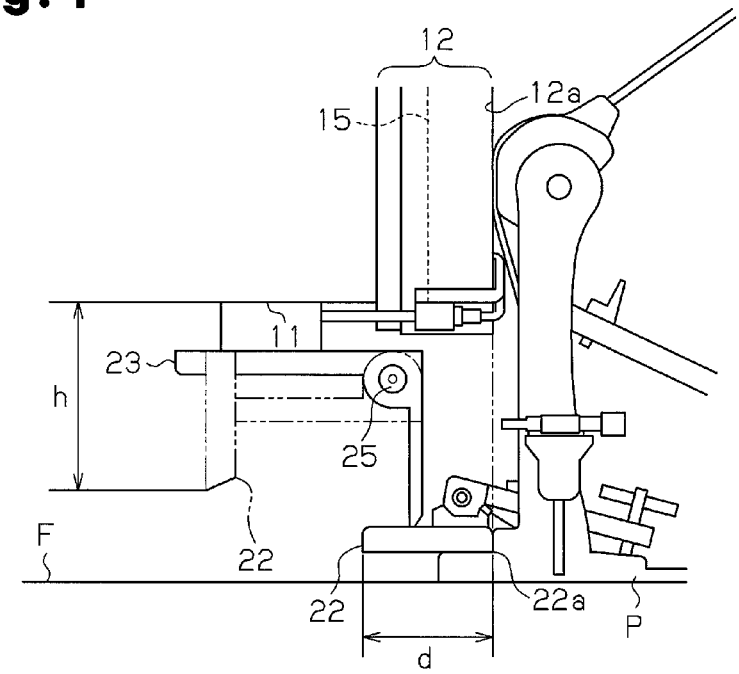
FIG. 4 is an enlarged partial side view showing a connection portion between a pedal connection member of the bass drum lifter and a pedal device.

As shown in FIG. 4, the long screw 25 is arranged in the vicinity of the shell 11 and in the vicinity of the batter head 15. The long screw 25 is arranged in a position radially aligned with the hoop 12 in the radial direction of the shell 11. An end surface 22*a* of the pedal connection member 22 can be arranged in the same plane as an end surface 12*a* of the hoop 12 facing the pedal device P in a state in which the pedal connection member 22 is placed in the use position.

The back face of the retainer 30 has an engraved mark so that the end surface 22*a* of the pedal connection member 22 can be arranged in the same plane as the end surface 12*a* of the hoop 12. The mark is made of line segments orthogonal to the elongated hole 30*a* and provided in two places corresponding to the pair of the bolts 40. When the bass drum lifter 20 is connected to the pedal device P, the bolts 40 are both set to coincide with the corresponding marks first and fastened to the screw holes 35*a*. Therefore, the retainer 30 is fixed to an initial position relative to the base 33. In this state, the pedal connection member 22 is placed in the use position and connected to the pedal device P, whereby the end surface 22*a* of the pedal connection member 22 is arranged in the same plane as the end surface 12*a* of the hoop 12. The retainer 30 is allowed to slide to the base 33 by loosening the bolts 40 screwed to the screw holes 35*a* and therefore the front-rear position of the pedal device P can be changed.

Next, operation of the above bass drum lifter 20 will be described.

As shown in FIG. 1, the bass drum lifter 20 can take the non-use form as shown by the alternate long and two short dashed lines and the use form as shown by the solid lines by rotating the pedal connection member 22 around the axis of the long screw 25. When the bass drum lifter 20 is used, the pedal connection member 22 is opened first to the drum connection member 23. Then, the pedal connection member 22 is fixed to the use position and the pedal device P is connected to the bass drum lifter 20. In contrast, when the bass drum lifter 20 is not used, the pedal device P is removed first from the bass drum lifter 20. Next, the pedal connection member 22 is closed to the drum connection member 23. Then, the pedal connection member 22 is fixed to the storage position. The bass drum lifter 20 can be therefore stored and carried while staying attached to the bass drum in a folded state.

In this case, since the pedal connection member 22 rotates around the vicinity of the shell 11 as shown in FIG. 4, the bass drum lifter 20 can be folded compactly with a vertical dimension h made small. A front-rear dimension d can also be made small when the pedal connection member 22 is placed in the use position because the rotational center of the pedal connection member 22 is arranged in the vicinity of the batter head 15. In this case, the vertical dimension h is reduced to be small when the pedal connection member 22 is placed in the storage position. It is therefore possible to make the vertical dimension h much smaller when the bass drum lifter 20 is folded. Moreover, when the pedal connection member 22 is placed in the storage position in this case as shown in FIG. 5, the retainer 30 to constitute the drum connection member 23 is entirely placed within the cutout 28*a* of the pedal connection members 22. The bass drum lifter 20 can be therefore folded more compactly without interference between the pedal connection member 22 and the drum connection member 23.

Accordingly, the following advantages are achieved in the present embodiment.

(1) The long screw 25 is arranged in the vicinity of the shell 11 and in the vicinity of the batter head 15. Owing to this configuration, the pedal connection member 22 rotates around the vicinity of the shell 11. It is therefore possible to fold the bass drum lifter 20 compactly while making its vertical dimension h small. By arranging the rotational center of the pedal connection member 22 in the vicinity of the batter head 15, the front-rear dimension d is made small when the pedal connection member 22 is placed in the use position. In this case, the vertical dimension h is reduced to be small when the pedal connection member 22 is placed in the storage position. Therefore, the vertical dimension h is made much smaller when the bass drum lifter 20 is folded.

(2) The long screw 25 is arranged in a position radially aligned with the hoop 12 in the radial direction of the shell 11. Owing to this configuration, the rotational center of the pedal connection portion 27 is arranged in the vicinity of the batter head 15. Therefore, the front-rear dimension d is made much smaller when the pedal connection member 22 is placed in the use position. Therefore, the vertical dimension h is made much smaller when the bass drum lifter 20 is folded.

(3) The end surface 22*a* of the pedal connection member 22 can be arranged to be in the same plane as the end surface 12*a* of the hoop 12 facing the pedal device P in a state in which the pedal connection member 22 is placed in the use position. Owing to this configuration, the front-rear dimension d is made much smaller when the pedal connection member 22 is placed in the use position. Therefore, the vertical dimension h is made much smaller when the bass drum lifter 20 is folded.

In addition, since the end surface 22*a* of the pedal connection member 22 is arranged in the same plane as the end surface 12*a* of the hoop 12, the position of the pedal device P in the front-rear direction remains the same irrespective to whether or not the part in the vicinity of the batter head 15 is lifted up. Therefore, when the part in the vicinity of the batter head 15 is not lifted up as well as when it is lifted up, the angle of the beater to hit the batter head 15 remains the same. This allows a player to play the bass drum 10 with a small diameter in the same feeling as playing a bass drum with a large diameter.

(4) The pedal connection member 22 is provided with the projections 28 to be abutted on the floor surface F. The projections 28 project to the opposite side of the pedal connection portion 27 in relation to the lift portion 26. Owing to this configuration, for example, the projections 28 are abutted on the floor surface F when the pedal device P is connected to the pedal connection member 22, whereby making it difficult for the bass drum lifter 20 to fall down. This makes it easier to hold the pedal connection member 22 in the use position and therefore operation to connect the pedal device P to the bass drum lifter 20 is easily carried out.

(5) The cutout 28*a*, which has a slightly wider width than the lift portion 26, is formed between the projections 28. Owing to this configuration, the retainer 30, which is a part of the drum connection member 23, can be entirely placed within the cutout 28*a* when the pedal connection member 22 is placed in the storage position. Therefore, the bass drum lifter 20 is folded more compactly without interference between the pedal connection member 22 and the drum connection member 23.

(6) The rotation restricting member 45 for restricting rotation of the pedal connection member 22 beyond the use position is provided in the connection portion of the lift portion 26 and the drum connection member 23. Owing to this configuration, it is possible to restrict rotation of the pedal connection member 22 by causing the end surface 30*b* of the retainer 30 to abut on the back face 26*a* of the lift portion 26 when, for example, the bass drum 10 is played. This makes it less likely for the bass drum lifter 20 to fall, and therefore the posture of the bass drum 10 lifted up by the bass drum lifter 20 is be stabilized.

(7) The drum connection member 23 is provided with the retainer 30 connected to the lift portion 26 and the base 33 placed on the retainer 30. The base 33 is slidably supported on the retainer 30 along the elongated hole 30*a*. Owing to this configuration, a player can change the position of the pedal device P relative to the bass drum 10 by sliding the retainer 30 to the base 33. As a result, depending on the size of the bass drum 10 and/or according to the player's preferences, the position of the pedal device P can be adjusted freely relative to the bass drum 10.

(8) The retainer 30 is installed in the base 33 in an attachable/detachable manner. Owing to this configuration, the retainer 30 can be removed from the base 33 along with the pedal connection member 22. It is therefore possible to connect the pedal device P to the hoop 12 of the bass drum 10 or other components without lifting a part in the vicinity of the batter head 15 of the bass drum 10. As a result, depending on the size of the bass drum 10 and/or according to the player's preferences, the variation in the way of using the bass drum lifter 20 is expanded.

The present embodiment may be modified as follows.

Figure 6:
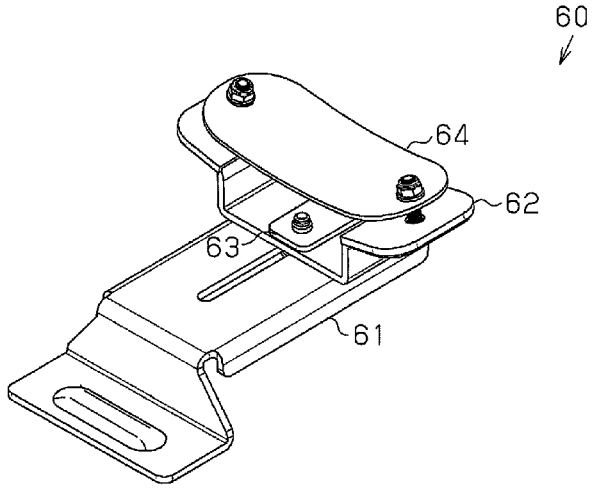
FIG. 6 is a perspective view showing a bass drum lifter according to a modification.

Although the bass drum lifter 20 described above has a structure in which the pedal connection member 22 is folded by being rotated around the axis of the long screw 25, a bass drum lifter 60 as shown in FIG. 6 may be employed. As shown in FIG. 6, the bass drum lifter 60 is provided with a lifter main body 61, a base 62 placed on the lifter main body 61, a plate 63 with nuts, and a shock-absorbing plate 64. The lifter main body 61 is obtained by integrally forming the pedal connection member 22 and the retainer 30 for forming the bass drum lifter 20 as shown in FIG. 1. The bass drum lifter 60 as shown in FIG. 6 is suitable for use when a part in the vicinity of the batter head 15 of the bass drum 10 is lifted up by a small amount.

Figure 7:
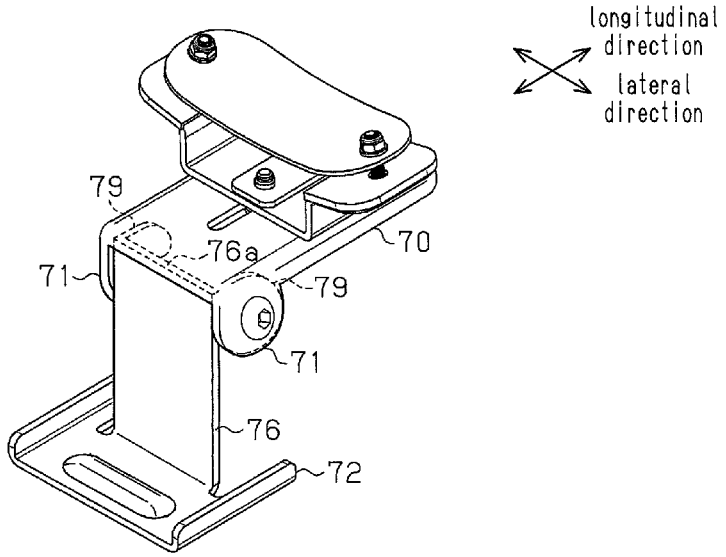
FIG. 7 is a perspective view showing a bass drum lifter according to another modification.
Figure 8:
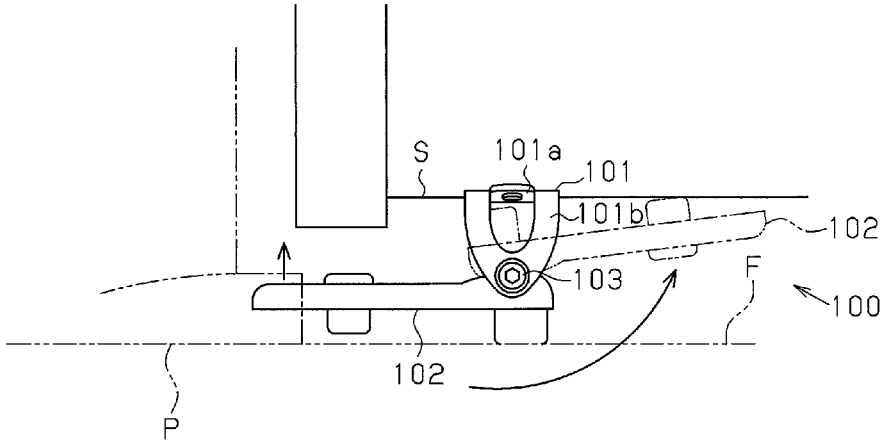
Fig.8(Prior Art)
FIG. 8 is a partial side view showing a state in which a bass drum is lifted up by using a conventional bass drum lifter.
Figure 9:
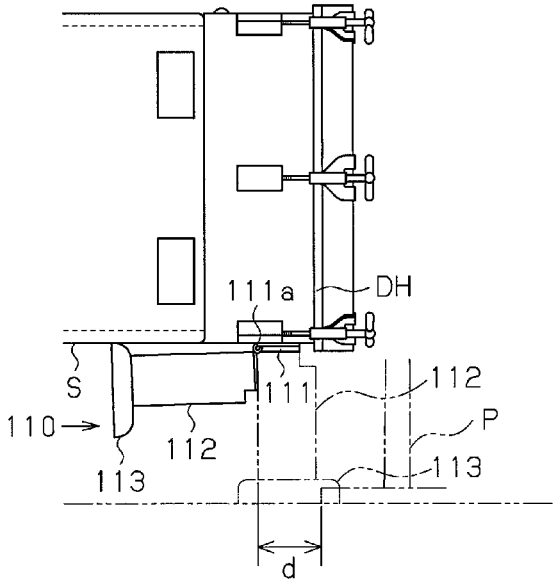
Fig.9(Prior Art)
FIG. 9 is a partial side view showing a conventional bass drum lifter in a non-use form.

Although the long screw 25 is passed through the holes 29*a* and 31*a* of the connection pieces 31 and 29 respectively in the above embodiment in a state in which the connection pieces 31 of the retainer 30 are placed between the connection pieces 29 of the lift portion 26, the positional relation of the connection pieces 31 of the retainer 30 with the connection pieces 29 of the lift portion 26 may be opposite. That is, in a state in which connection pieces 79 of a lift portion 76 are placed between connection pieces 71 of a retainer 70 as shown in FIG. 7, the long screw 25 may be passed through holes of the connection pieces 79 and 71. In this case, an end surface 76*a* of the lift portion 76 may be abutted on the back face of the retainer 70 to restrict rotation of the pedal connection member 72.

Although the long screw 25 is arranged in a position radially aligned with the hoop 12 in the radial direction of the shell 11 in the above embodiment, it may be arranged in a front position or rear position away from the hoop 12 as long as it is arranged in the vicinity of the shell 11 and in the vicinity of the batter head 15.

Although the end surface 22*a* of the pedal connection member 22 is arranged in the same plane as the end surface 12*a* of the hoop 12 facing the pedal device P in the above embodiment, the end surface 22*a* may be arranged in a front position or rear position away from the end surface 12*a* of the hoop 12.

The projections 28 may be omitted from the pedal connection member 22 in the above embodiment.

The cutout 28*a* may be omitted from the projections 28 in the above embodiment.

Although the base 33 is made to slide along the elongated hole 30*a* of the retainer 30 in the above embodiment, a plurality of fitting holes may be formed in the retainer 30 in place of the elongated hole 30*a*. For example, a plurality of fitting holes may be arranged at even intervals along the longitudinal direction of the retainer 30. According to this configuration, a player can adjust the position of the pedal device P relative to the bass drum 10 in a stepwise manner by changing the position of the retainer 30 fitted to the base 33.

The base 33 may be fixed onto the retainer 30 in the above embodiment. That is, the function to adjust the position of the pedal device P relative to the bass drum 10 may be omitted from the bass drum lifter 20.

The function to make the retainer 30 attachable to and detachable from the base 33 may be omitted from the bass drum lifter 20 in the above embodiment.

An unprocessed screw may be used as a shaft in the above embodiment in place of the long screw 25 as long as it functions as a shaft to rotationally connect the pedal connection member 22 and the drum connection member 23.

The invention claimed is:

1. A base drum lifter adapted to be connected to a part of a bass drum in the vicinity of a batter head and to a pedal device and adapted to lift the part in the vicinity of the batter head, the bass drum lifter comprising:

a drum connection member to be connected to the bass drum;

a pedal connection member including a lift portion for lifting the bass drum; and a shaft for rotationally connecting the pedal connection member and the drum connection member to each other, wherein the pedal connection member is rotational around the shaft between a storage position in the vicinity of the shell of the bass drum and a use position, at which the bass drum is lifted by the lift portion, a hoop is fitted with the batter head to an opening end of the shell, the shaft is arranged in the vicinity of the shell and the batter head, wherein the drum has an axis, the shaft has an axis that lies in a plane perpendicular to the axis of the drum, and the plane intersects the hoop, the pedal connection member has a pedal connection portion to be connected to the pedal device and a projection arranged on an opposite side of the pedal connection portion in relation to the lift portion, the projection has a cutout, and the drum connection member is partially placed within the cutout when the pedal connection member is arranged in the storage position.

2. A base drum lifter adapted to be connected to a part of a bass drum in the vicinity of a batter head and to a pedal device and adapted to lift the part in the vicinity of the batter head, the bass drum lifter comprising:

a drum connection member to be connected to the bass drum;

a pedal connection member including a lift portion for lifting the bass drum; and a shaft for rotationally connecting the pedal connection member and the drum connection member to each other, wherein the pedal connection member is rotational around the shaft between a storage position in the vicinity of the shell of the bass drum and a use position, at which the bass drum is lifted by the lift portion, a hoop is fitted with the batter head to an opening end of the shell, the shaft is arranged in the vicinity of the shell and the batter head, wherein the drum has an axis, the shaft has an axis that lies in a plane perpendicular to the axis of the drum, and the plane intersects the hoop, a rotation restricting member is provided at a connection portion between the lift portion and the drum connection member, the rotation restricting member restricting rotation of the pedal connection member beyond the use position, and the rotation restricting member restricts rotation of the pedal connection member by causing the lift portion to abut against the drum connection member.

3. The bass drum lifter according to claim 2, wherein, in a state in which the pedal connection member is arranged in the use position, an end surface of the pedal connection member can be arranged in the same plane as an end surface of the hoop.

4. The bass drum lifter according to claim 2, wherein the drum connection member has a base fixed to the bass drum and a retainer, which is connected to the lift portion and supports the base such that the base is movable in a front-rear direction, and the position of the pedal device is changeable relative to the bass drum by moving the retainer relative to the base.

5. The bass drum lifter according to claim 4, wherein the retainer is attachable to and detachable from the base.

6. A bass drum comprising a bass drum lifter, the bass drum lifter being adapted to lift a part of the bass drum in the vicinity of a batter head, and to be connected to the part in the vicinity of the batter head of the bass drum and to a pedal device, the bass drum lifter including:

a drum connection member to be connected to the bass drum;

a pedal connection member including a lift portion for lifting the bass drum; and a shaft for rotationally connecting the lift portion of the pedal connection member and the drum connection member to each other, wherein the pedal connection member is rotational around the shaft between a storage position in the vicinity of the shell of the bass drum and a use position, at which the bass drum is lifted up by the lift portion, a hoop is fitted with the batter head to an opening end of the shell, the shaft is arranged in the vicinity of the shell and the batter head, wherein the drum has an axis, the shaft has an axis that lies in a plane perpendicular to the axis of the drum, and the plane intersects the hoop, a rotation restricting member is provided at a connection portion between the lift portion and the drum connection member, the rotation restricting member restricting rotation of the pedal connection member beyond the use position, and the rotation restricting member restricts rotation of the pedal connection member by causing the lift portion to abut against the drum connection member.

* * * * *